US006575386B1

(12) United States Patent
Thurber, Jr. et al.

(10) Patent No.: US 6,575,386 B1
(45) Date of Patent: Jun. 10, 2003

(54) SPA NOZZLES WITH AIR ENTRAINMENT

(75) Inventors: Jerry Wayne Thurber, Jr., Woodbine, MD (US); Keith Schloer, Owings Mills, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 09/899,547

(22) Filed: Jul. 6, 2001

Related U.S. Application Data

(60) Provisional application No. 60/217,378, filed on Jul. 11, 2000.

(51) Int. Cl.[7] ..... F23D 11/10

(52) U.S. Cl. ..... 239/418; 239/428; 239/428.5; 239/433; 239/589; 239/589.1; 239/590; 239/590.3; 239/590.5

(58) Field of Search ..... 239/428, 589, 239/428.5, 418, 589.1, 590, 590.3, 590.5, 433

(56) References Cited

U.S. PATENT DOCUMENTS 3,741,481 A * 6/1973 Bauer ..... 239/589.1
4,122,845 A * 10/1978 Stouffer et al. ..... 239/589.1
4,227,550 A 10/1980 Bauer et al. ..... 137/835
4,662,568 A * 5/1987 Bauer ..... 239/589.1
4,955,547 A * 9/1990 Woods ..... 239/589.1
5,238,585 A 8/1993 Reed, Sr. ..... 210/805
5,339,695 A * 8/1994 Kang et al. ..... 73/195
5,444,879 A 8/1995 Holtsnider ..... 4/541.01
5,457,825 A 10/1995 Holtsnider ..... 4/541.1
5,495,627 A 3/1996 Leaverton et al. ..... 4/541.6
5,524,660 A * 6/1996 Dugan ..... 137/14
5,749,525 A * 5/1998 Stouffer ..... 239/284.1

* cited by examiner

*Primary Examiner*—Robin O. Evans
(74) *Attorney, Agent, or Firm*—Jim Zegeer

(57) ABSTRACT

An air entrainment spa nozzle having a jet of water which passes over an air entrainment port with the air entrainment port having a downstream structure which enhances the air entrainment. In one embodiment, the air enhancement structure is a ramp which extends in a downstream direction from the air entrainment port. In another embodiment, the air entrainment port projects or protrudes into the jet of water by a predetermined amount.

9 Claims, 7 Drawing Sheets

SPA NOZZLES WITH AIR ENTRAINMENT

REFERENCE TO RELATED APPLICATIONS

This application is the subject of provisional application Serial No. 60/217,378 filed Jul. 11, 2000 entitled AIR ENTRAINMENT TECHNIQUES FOR SPA NOZZLES.

BACKGROUND AND BRIEF DESCRIPTION OF THE INVENTION

This invention relates to spa nozzles having air entrainment and more particularly to fluidic spa nozzles having air entrainment.

It is common practice to provide an air line to spa nozzles for aeration of exhausting water. The air typically is drawn by the water through the venturi effect of the flowing water, and sometimes air is supplied under pressure from an air pump. See U.S. Pat. Nos. 5,495,627, 5,457,825, 5,444,879 and 5,238,585.

The present invention is directed to a method and apparatus for increasing entrainment volume. The invention is directed to an air entrainment spa nozzle wherein a jet of water passes over an air entrainment port and air entrainment is enhanced by a ramp surface extending in a downstream direction from the air entrainment port. In a preferred embodiment, a fluidic oscillator causes sweeping motions of the jet of water and has a pair of control ports immediately downstream of the power nozzle. In one embodiment, the control ports are part of a crossover-type fluidic oscillator having feedback passages, and the entrainment port is located at the exit of an oscillation chamber. In another fluidic embodiment, an inertance loop interconnects the control ports to induce oscillation of the jet of water, and the air entrainment port is located immediately downstream of the control ports.

Other fluidic oscillators may be used in practicing the invention.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
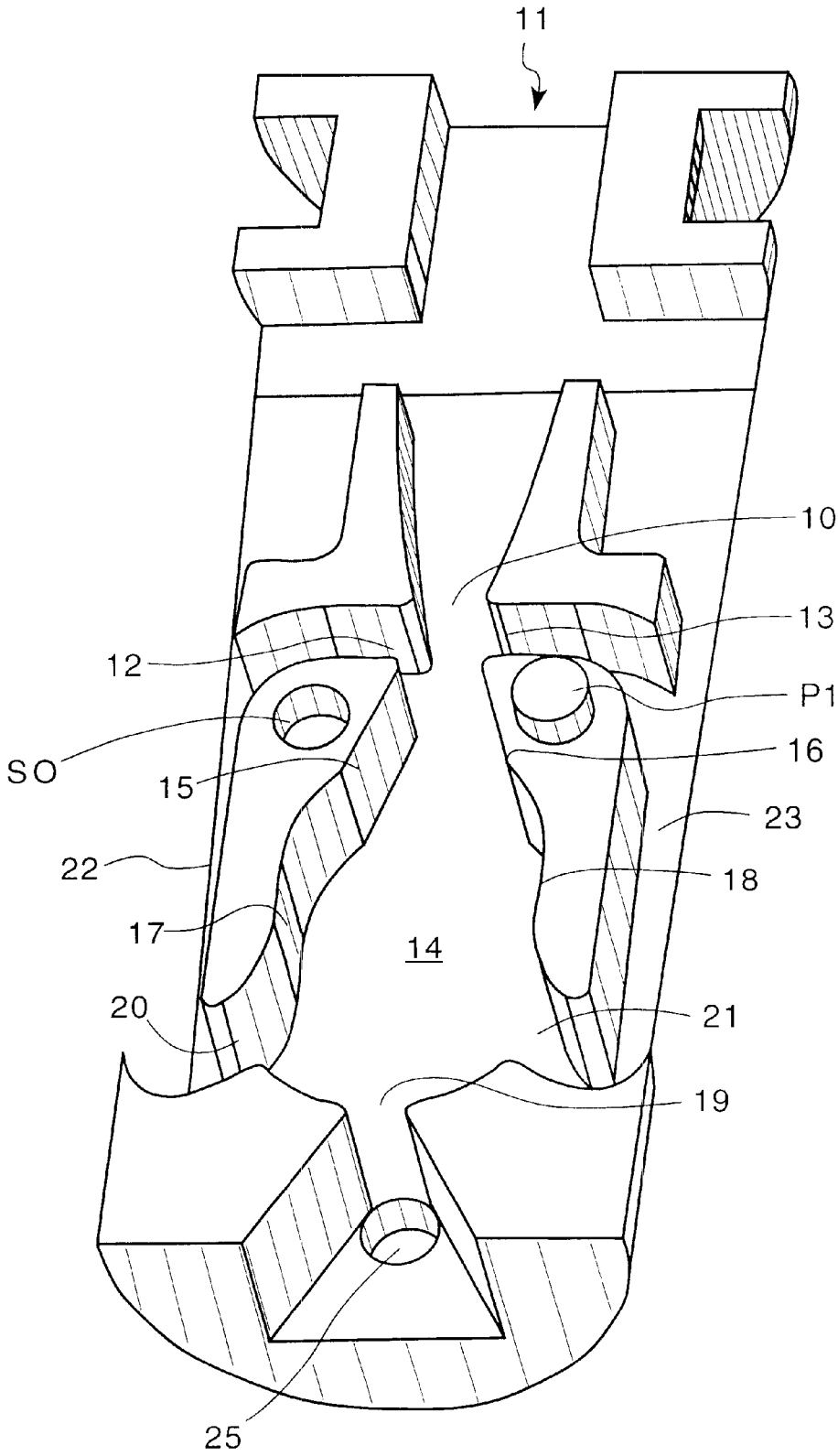
FIG. 1 shows one preferred embodiment of the invention where the air inlet is at the exit of a crossover-type feedback fluidic oscillator spa nozzle.

The embodiments of the invention shown in FIGS. 1–4 is in connection with a conventional feedback fluidic oscillator having a power nozzle 10 which is supplied with water from a source 11 and projects a jet of water past control ports 12 and 13 into a crossover oscillation chamber 14. The fluidic oscillator is of the type having attachment walls 15 and 16 and curved downstream walls 17, 18 and a downwardly tapered floor F (FIG. 4) leading to an outlet throat 19 and feedback entranceways 20, 21. When assembled in the housing (not shown), the feedback ports 20, 21 couple with feedback passages 22, 23 to control ports 12 and 13 to constitute a conventional feedback-type fluidic oscillator. In normal operation, the power jet expands sufficiently to fill the outlet throat 19 before the interaction region and the oscillation feedback channels begin to fill. Vortices are formed on either side of the water jet, but, since two vortices cannot exist simultaneously with equal intensity, one vortex becomes dominant, and the jet or power stream will be diverted against the opposite wall. Assuming it is against the sidewalls 17, the water flows along the sidewall 17 and through the exit aperture 19 exiting to the right in FIG. 1. At the same time, fluid enters the feedback entranceway 20 and feedback passage 22 to direct a control signal through control port 12 to cause the jet to detach from attachment wall 15 and switch jet or crossover to the opposite side to repeat the process. Thus, the jet of water sweeps in the outlet apertures 19, right and left, back and forth as is well known in the art. Pin P1 and socket SO lock the oscillatory unit in a housing (not shown). All units and component parts are preferably made of molded plastics, but metal moldings are within the scope of the invention.

THE PRESENT INVENTION

Figure 2:
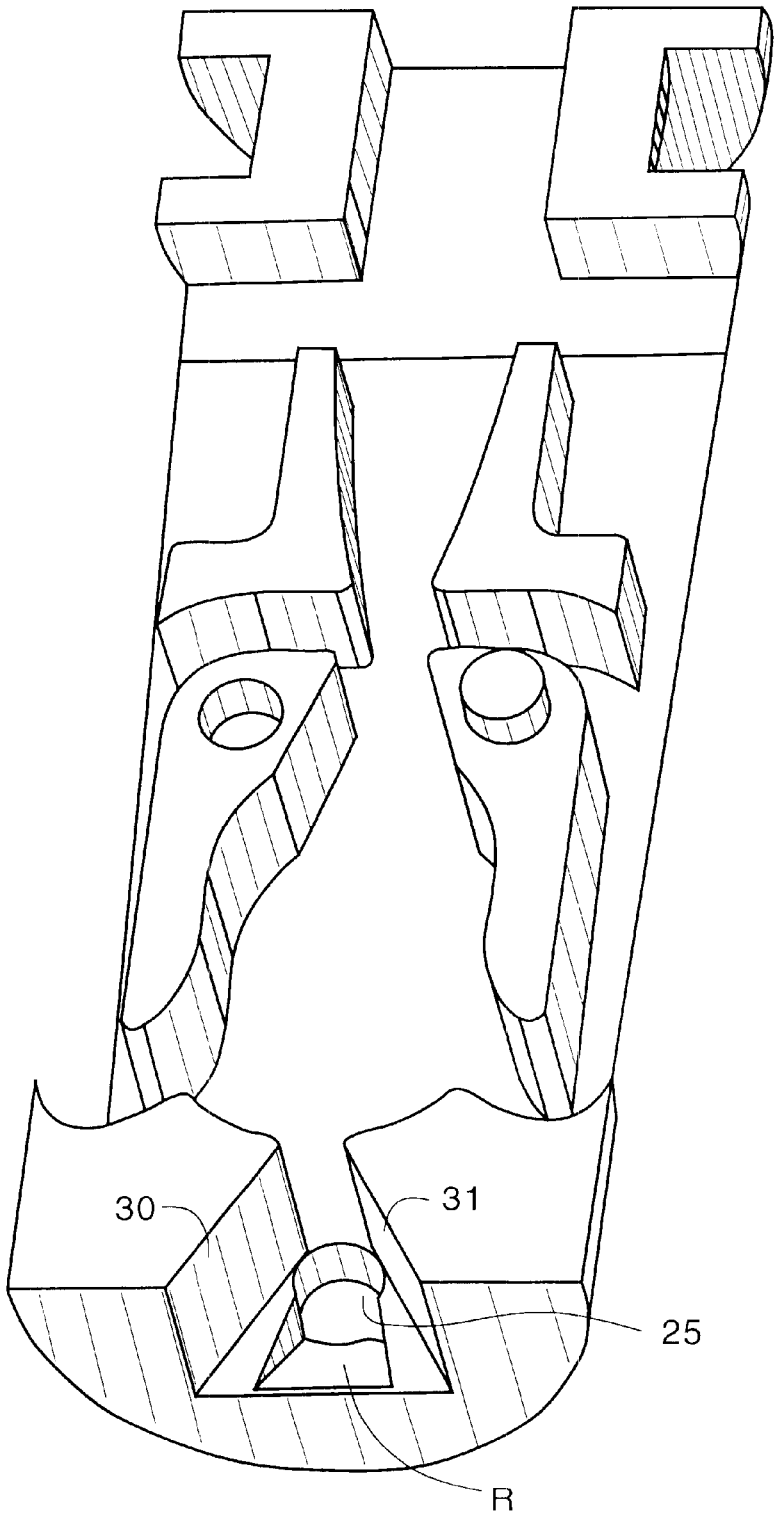
FIG. 2 shows the invention which comprises the addition of a ramp starting from the downstream end of the outlet, tapering down towards the air inlet port and terminating at the air inlet.
Figure 3:
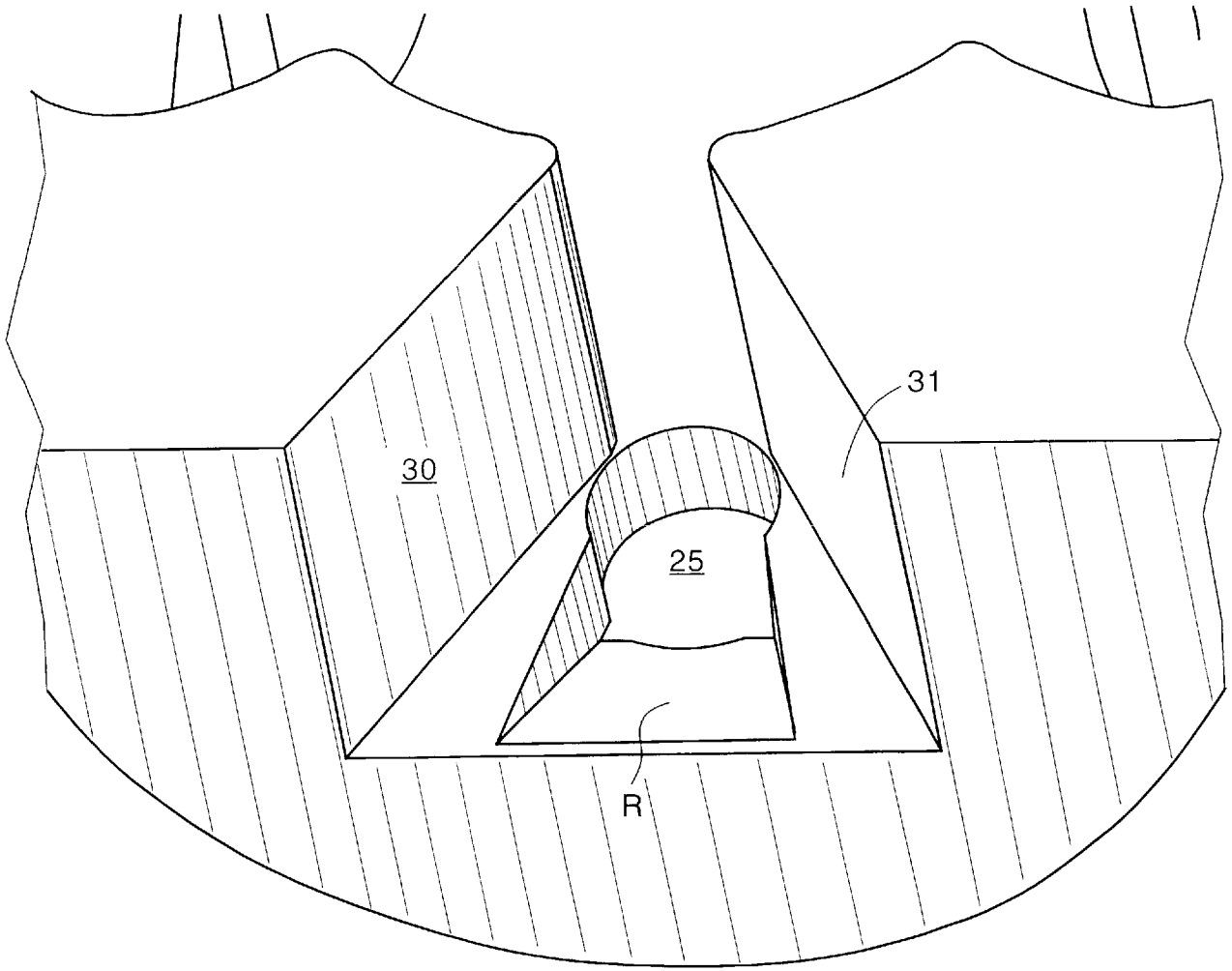
FIG. 3 is an enlarged view of the nozzle exit throat/air inlet area.
Figure 4:
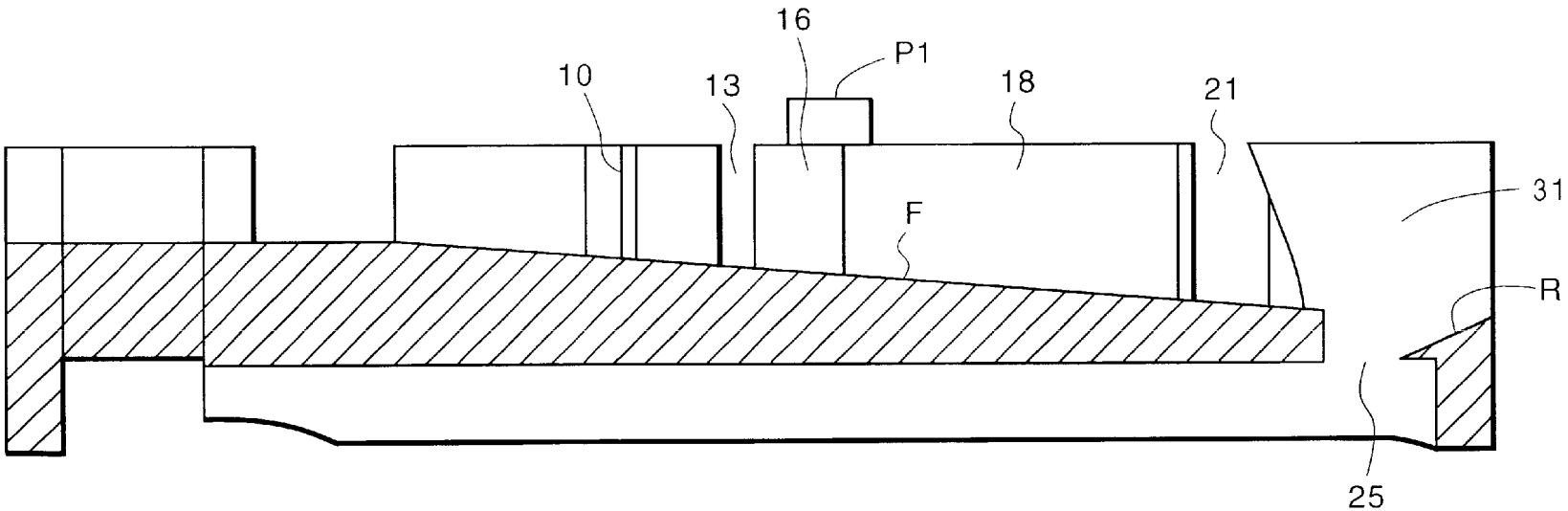
FIG. 4 is a sectional view showing the ramp and air inlet.
Figure 5A:
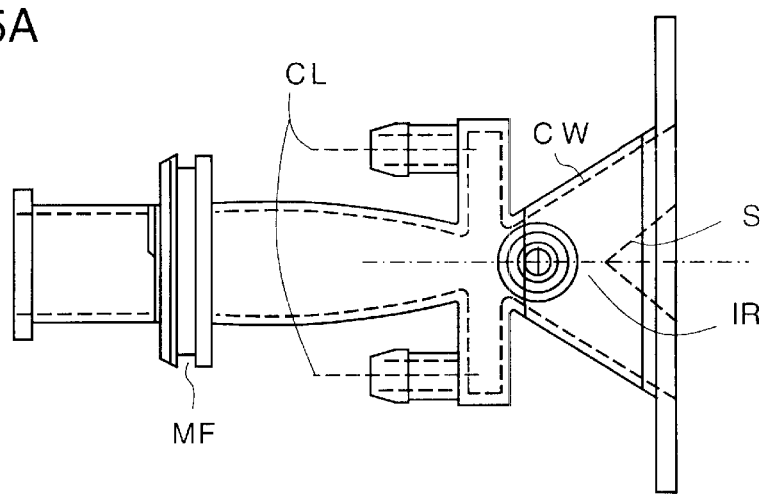
FIG. 5A is a top plan view of a further embodiment of the invention.
Figure 5B:
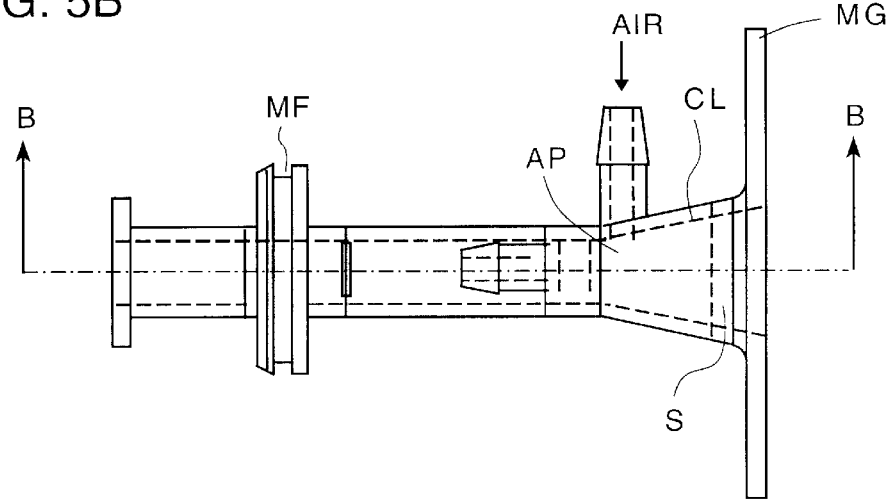
FIG. 5B is a side elevational view.
Figure 5C:
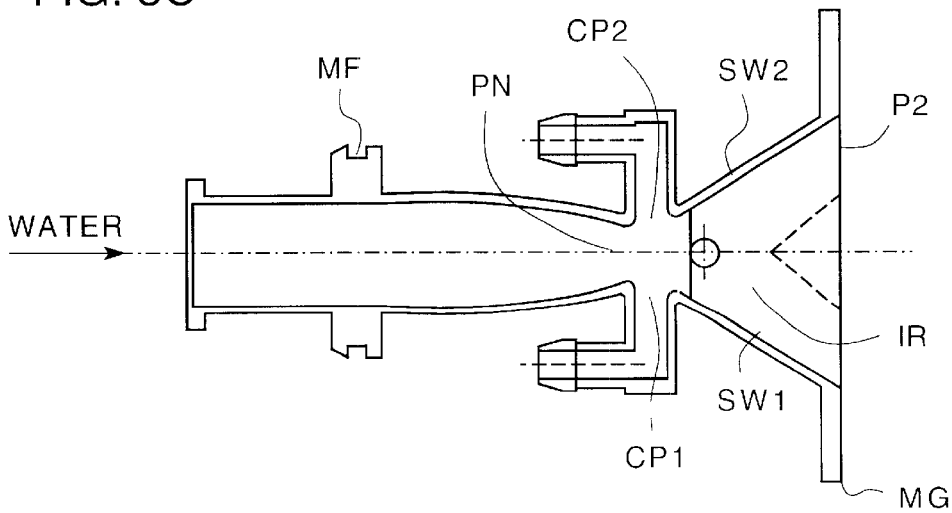
FIG. 5C is a sectional view through lines BB of FIG. 5B.
Figure 5D:
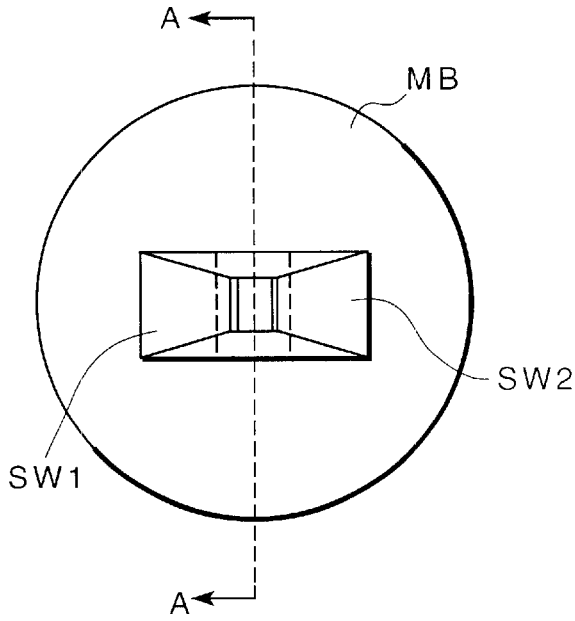
FIG. 5D is a front elevational view.
Figure 5E:
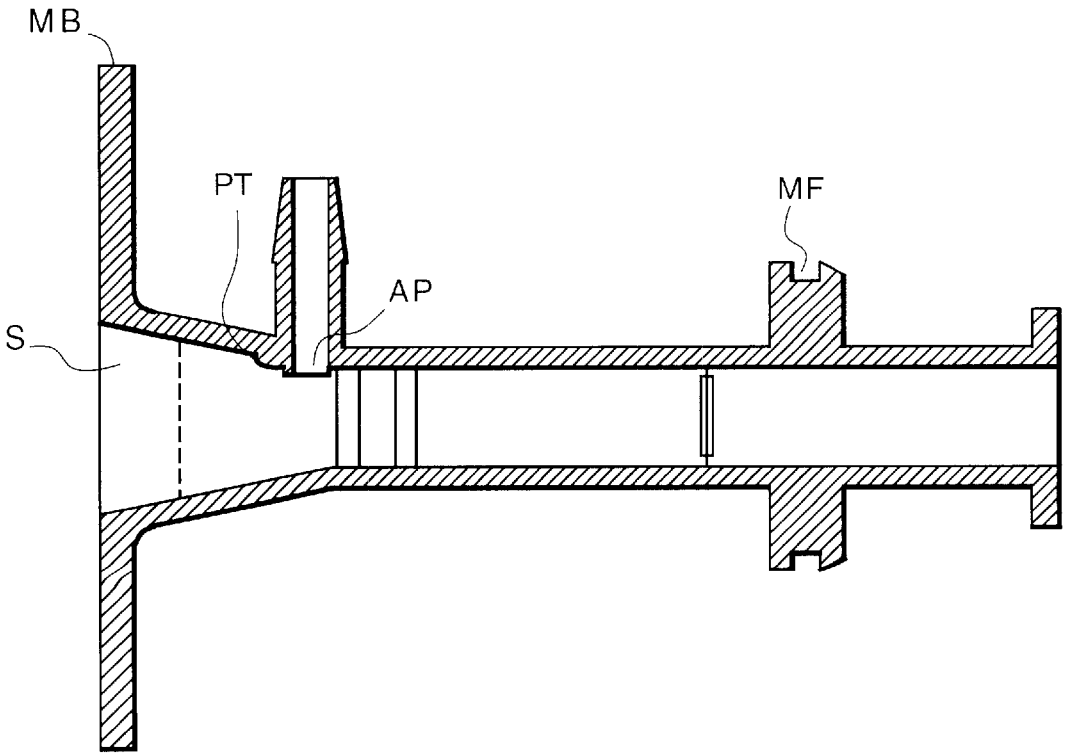
FIG. 5E is a sectional view through lines AA of FIG. 5D, FIGS. 6 and 7 correspond to FIG. 5E and show different embodiments of the invention wherein the air entrainment port is located immediately downstream of the control port, and the entrainment port protrudes into the flow by differing amounts.
Figure 6:
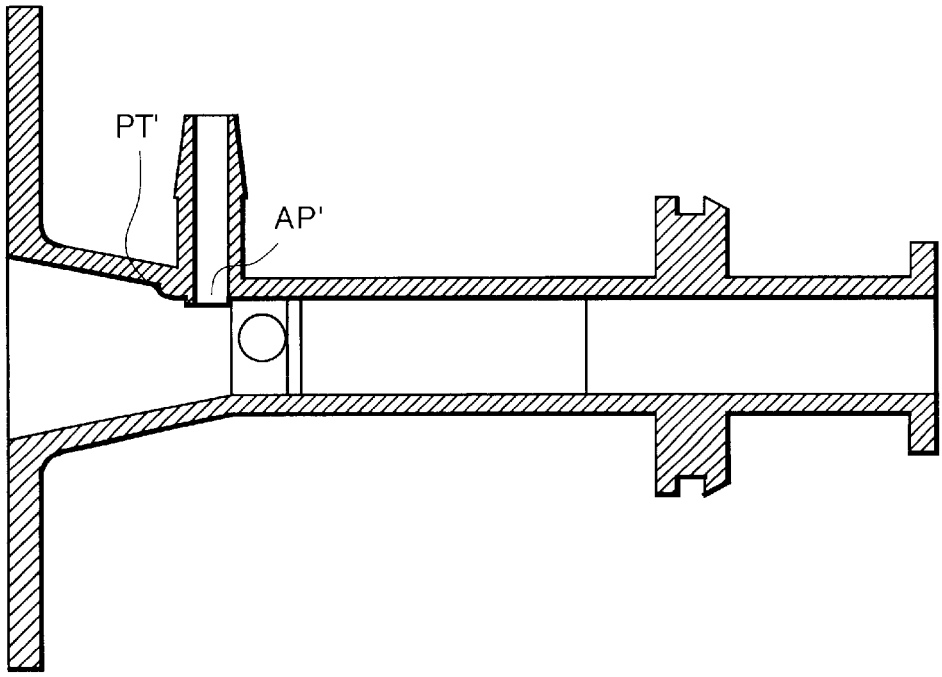
Figure 7:
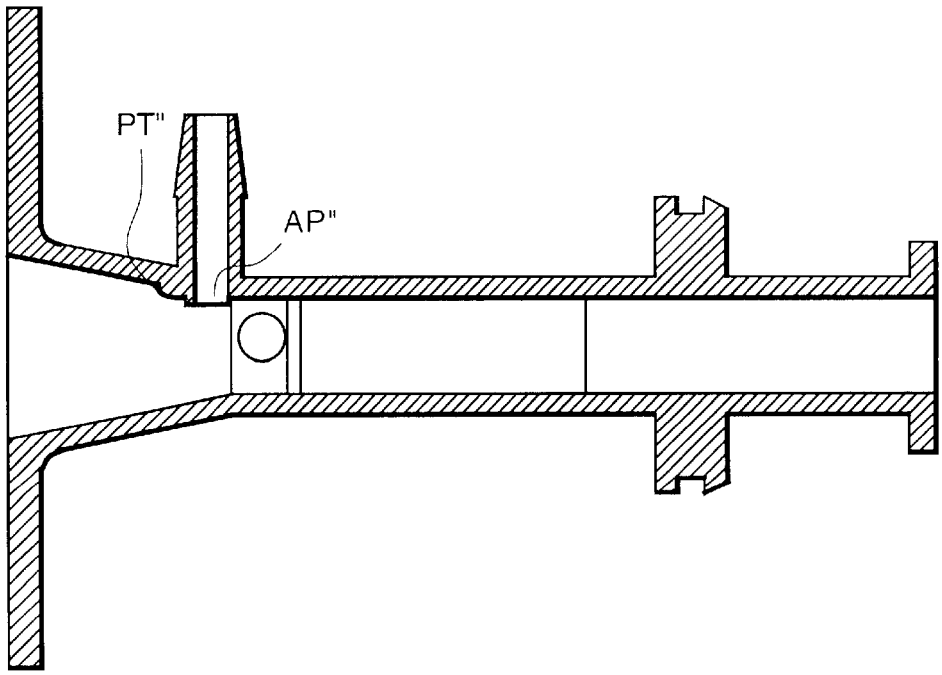

The present invention is directed to the air inlet port 25 and the structure of the surfaces downstream thereof. Referring now to FIG. 2, the outlet comprises a pair of diverging sidewalls 30, 31 which, structurally, define the limits of the sweeping jet of water and a top wall (top wall not shown) and bottom wall which contain air inlet port 25. In this embodiment of the invention, the ramp R, starting from the downstream end DE of the outlet and tapering down towards the air inlet hole 25 and terminating at the air inlet, enhances air entrainment.

It has been found that without the ramp R, the entrainment of air almost ceases when the nozzle was immersed beyond a certain depth. Air entrainment was brought up to satisfactory levels by adding the ramp R.

The following table shows the vacuum generated by adding the ramp. The tests were run at 15 psi at a depth of 28":

| Ramp Angle | Vacuum |
|---|---|
| 14° | 6 to 7 inches water |
| 20° | 20 inches water |
| 25° | 8 inches water |

As is readily seen from the above, there is a range of ramp angles beyond which the vacuum decreases. This technique can be used for any type fluidic oscillator or even a jet-type spa nozzle to induce entrainment.

Referring now to FIGS. 5A–5E, a fluidic oscillator of the inertance-loop-type is shown. In this type of fluidic oscillator, an interaction region IR having an upstream end and a downstream end. A power nozzle PN at the upstream end projects a jet of water into the interaction region IR. First and second control ports CP1 and CP2 at each side of the upstream end of the interaction region IR and at each side of the jet of water projecting into the interaction IR by the power nozzle PN are interconnected by a continuous inertance loop CL. The inertance loop CL may be varied in length (or include a variable fluidic circuit component) to vary the frequency of oscillation. The interaction region is defined by a pair of diverging sidewalls SW1, SW2, diverging floor and ceiling walls FW and CW, with the upstream end of the diverging sidewalls SW1 and SW2 being connected directly to the upstream wall forming the control ports CP1, CP2, respectively. Mounting flange MF and mounting bezel MB are provided for mounting in the spa tub. In operation, the water jet leaving the power nozzle PN interacts with the inertance loop CL to cause the jet of water to oscillate back and forth between the sidewalls S1 and S2 at a frequency determined by the continuous inertance loop CL, and the oscillating frequency is essentially proportional in the flow of water through the power nozzle PN. The higher the flow rate, the higher the frequency.

An air input port AP is positioned just downstream of the control port CP1 and CP2 and has a protrusion PT on a downstream side thereof. This downstream structure PT enhances air entrainment.

In some embodiments, such as in the embodiment shown in FIGS. 5A–5E, an optional splitter S (shown in dash lines) can be used to separate the two extreme output jet positions and provide alternating slugs of water for different massaging effects.

These embodiments show the entrainment port located immediately downstream of the control ports CP1, CP2 which, in contrast to the earlier embodiment, which shows the invention relative to the crossover-type fluidic (where the output jet flows in opposite directions to the jet exiting from the power nozzle). The arrangements shown in FIGS. 5A–5E, 6 and 7 can be used or without the splitters. These configurations show the entrainment port protruding into the flow by different amounts. When the entrainment port was flush with the floor, the vacuum generated was low, approximately 9 inches of water, while with the port protruding about 1/32 of an inch, the vacuum was 100 inches of water.

While preferred embodiments of the invention have been shown and illustrated and described in detail, it will be appreciated that many modifications, adaptations and changes can be made to the invention without departing from the basic spirit and scope of the present invention.

What is claimed is:

1. In an underwater spa nozzle wherein a jet of water passes over an air entrainment port, the improvement for enhancing air entrainment comprising a ramp surface extending in a downstream direction from said air entrainment port.

2. In an underwater air entrainment spa nozzle wherein a jet of water passes over an air entrainment port, the improvement wherein said air entrainment port has a downstream structure which enhances the air entrainment.

3. In an underwater spa nozzle, a fluidic oscillator for oscillating a jet of water back and forth and an air entrainment port over which said jet of water flows, said air entrainment port having a downstream structure for enhancing air entrainment.

4. The underwater spa nozzle as defined in claim 3 wherein said fluidic oscillator includes a power nozzle, an interaction region having sidewalls diverging to a terminal end, a pair of control ports, one at each side of said power nozzle, respectively, and an inertance loop interconnecting said control ports, said air entrainment port being located immediately downstream of said control ports and wherein said downstream structure for enhancing air entrainment includes a ramp structure extending from said control port to the terminal end of said interaction region.

5. A spa nozzle as defined in claim 4 wherein said ramp is at an angle of about 20°.

6. In a spa nozzle as defined in claim 3, further characterized in that said fluidic oscillator has an interaction region and a pair of control ports and said air entrainment port is located in said interaction region, immediately downstream of said control ports.

7. In a spa nozzle as defined in claim 3, further characterized in that said fluidic oscillator has an interaction region and a pair of control ports at the upstream end of said interaction region and a power nozzle for projecting a jet of water into said interaction region and a pair of feedback passages connecting said control ports with a downstream end of said interaction region, and said interaction region having an outlet to issue a sweeping jet of water into said spa, the improvement wherein said air entrainment port is downstream of said outlet aperture.

8. In a spa nozzle as defined in claim 3, further characterized in that said fluidic oscillator has an interaction region and a pair of control ports at the upstream. end of said interaction region, a power nozzle for projecting a jet of water into said interaction region and an inertance loop interconnecting said control ports and establishing a frequency of operation for said oscillator.

9. In a submerged spa nozzle as defined in claim 3 wherein said downstream structure is a ramp and said ramp has an angle of about 20° when submerged at a depth of about 28 inches.

* * * * *